US007099487B2

(12) United States Patent
Fukuda

(10) Patent No.: US 7,099,487 B2
(45) Date of Patent: Aug. 29, 2006

(54) MICROPHONE WITH ARM

(75) Inventor: Mikio Fukuda, Tokyo (JP)

(73) Assignee: Temco Japan Co., Ltd., Tokyo (JP)

( * ) Notice: Subject to any disclaimer, the term of this patent is extended or adjusted under 35 U.S.C. 154(b) by 183 days.

(21) Appl. No.: 10/240,318

(22) PCT Filed: Feb. 1, 2002

(86) PCT No.: PCT/JP02/00840

§ 371 (c)(1),
(2), (4) Date: Oct. 1, 2002

(87) PCT Pub. No.: WO02/063923

PCT Pub. Date: Aug. 15, 2002

(65) Prior Publication Data

US 2003/0076976 A1 Apr. 24, 2003

(30) Foreign Application Priority Data

Feb. 2, 2001 (JP) ..... 2001-26446

(51) Int. Cl.
*H04R 25/00* (2006.01)

(52) U.S. Cl. ..... 381/362; 381/361; 381/390

(58) Field of Classification Search ..... 381/356, 381/361–368, 375–376, 377, 379, 386, 390, 381/67; 248/559, 639, 284.1; 379/430; 455/90.3, 575

See application file for complete search history.

(56) References Cited

U.S. PATENT DOCUMENTS

| | | | | | |
|---|---|---|---|---|---|
| 619,445 | A | * | 2/1899 | Smith | 381/361 |
| 681,813 | A | * | 9/1901 | Ries | 381/362 |
| 745,049 | A | * | 11/1903 | Gamache | 381/362 |
| 2,485,405 | A | * | 10/1949 | Olney et al. | 379/430 |
| 3,014,998 | A | * | 12/1961 | Simpson et al. | 381/375 |
| 3,375,333 | A | * | 3/1968 | Hagopian | 381/363 |
| 4,831,656 | A | * | 5/1989 | Southern et al. | 381/361 |
| 5,876,008 | A | * | 3/1999 | Sweere et al. | 248/281.11 |
| 6,027,233 | A | * | 2/2000 | Chen | 362/402 |

FOREIGN PATENT DOCUMENTS

| | | |
|---|---|---|
| JP | 59 134983 | 9/1984 |
| JP | 59 169179 | 11/1984 |
| JP | 1 166413 | 11/1989 |
| JP | 3004155 | 11/1994 |
| JP | 3007978 | 2/1995 |
| JP | 8 163684 | 6/1996 |

* cited by examiner

*Primary Examiner*—Suhan Ni
(74) *Attorney, Agent, or Firm*—Browdy and Neimark, PLLC

(57) ABSTRACT

A microphone has an arm in a manner such that vibration generated by a loudspeaker or the like is transmitted to the microphone. The microphone characterized in that the arm supporting the microphone is constructed of a plurality of split arms, which are connected with each other through elastic members.

13 Claims, 6 Drawing Sheets

MICROPHONE WITH ARM

FIELD OF THE INVENTION

The present invention relates to a microphone provided with an arm, and more particularly to a microphone provided with an arm, which is an accessory of communication instruments such as wireless communication instruments, cell phones and the like and is mounted on a loudspeaker portion. Or, the present invention relates to a microphone provided with an arm disposed on a desk and the like.

BACKGROUND OF THE INVENTION

As a conventional accessory of communication instruments such as ones shown in FIGS. 8 and 9, there is provided a set of a loudspeaker and a microphone provided with an arm extending toward a user's mouth, wherein the microphone is mounted on a front end portion of the arm. In the set shown in FIG. 8 there is provided a headphone provided with a housing portion 31 of a loudspeaker, on which portion 31 an arm 32 provided with a microphone 33 in its front end is fixedly mounted. In the set shown in FIG. 9, there is provided the loudspeaker 31 with which the arm 32 is directly connected.

When two-way communication is conducted between a user and his or her communication partner using such a set of cell phone and the like, voices and sounds issued from the loudspeaker are transmitted and returned to the microphone through the arm, which disturbs the communication partner in hearing and often causes howling to occur at the side of the communication partner. This howling tendency is remarkably recognized when the cell phone or like communication instrument used by the communication partner is of a type employing a bone conduction loudspeaker.

In order to solve this problem, in the conventional communication-instruments, a soft rubber boot and like articles is disposed in a space between a microphone unit and a casing receiving the microphone unit therein to prevent vibrations of the loudspeaker from being transmitted to thee microphone. However, this is not sufficient in effect as is in various other conventional measures.

Although there are the other conventional measures such as one using a microphone provided with an arm disposed on a desk, any one of these conventional measures is insufficient in effect since all the vibrations and impacts applied to the desk are transmitted to the microphone through the arm and picked up by the microphone as noises.

Since the conventional microphone provided with the conventional arm suffers from the above-mentioned problems, it is an object of the present invention to provide a microphone provided with an arm, which is free from the above-mentioned problems. In other words, the microphone provided with the arm of the present invention is capable of preventing any vibration produced in the loudspeaker and the like from being transmitted to the microphone.

SUMMARY OF THE INVENTION

The present invention provides a microphone provided with an arm, which is characterized in that the arm for supporting the microphone is split into ac plurality of spit arms; and, the split arms are connected with each other through an elastic element.

BEST MODE FOR CARRYING OUT THE INVENTION

Figure 1A:
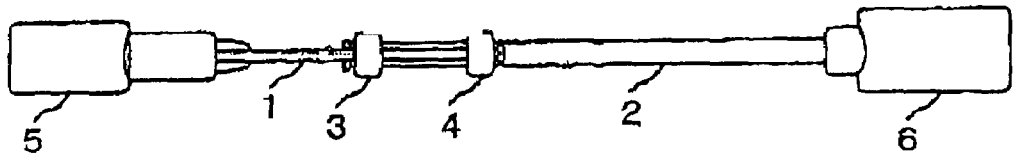
FIGS. 1(A) and (B) are respectively a plan and a side view illustrating an embodiment of a microphone provided with an arm according to the patent invention.
Figure 1B:
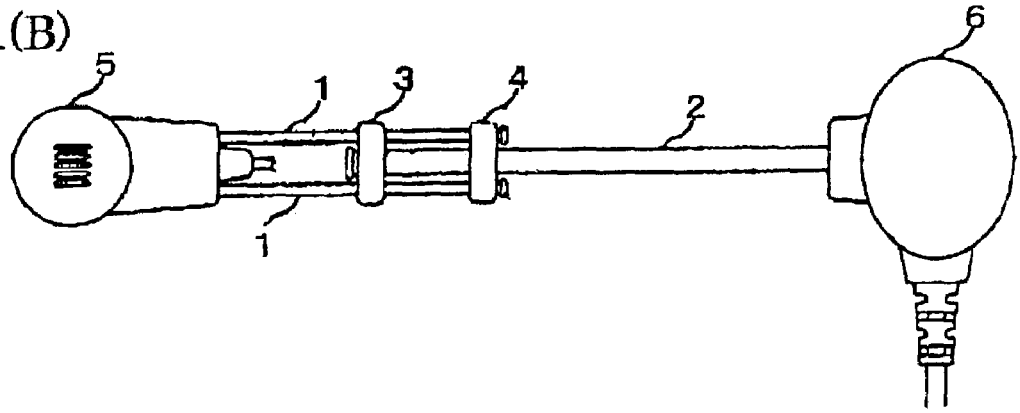
Figure 3A:
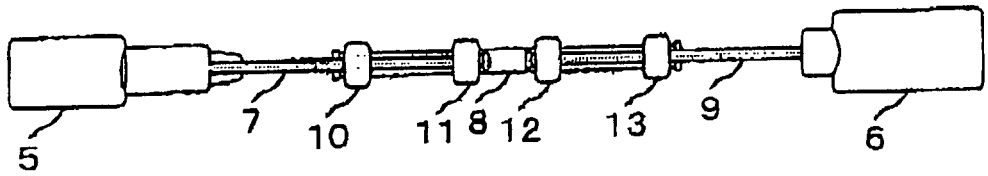
FIGS. 3(A) and (B) are respectively a plan and a side view illustrating a second embodiment of the microphone provided with the arm according to the present invention.
Figure 3B:
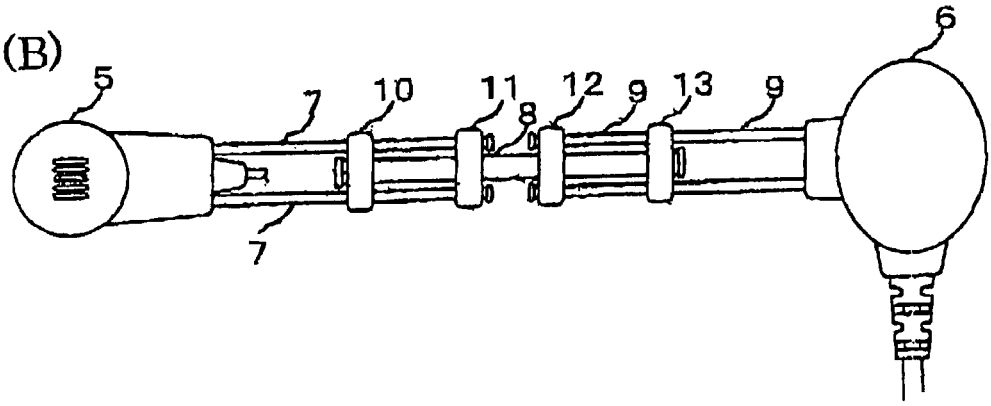
Figure 4A:
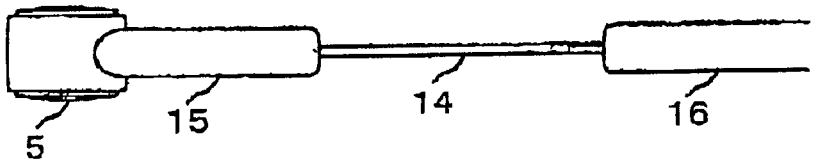
FIGS. 4(A) and (B) are respectively a plan and a side view illustrating a third embodiment of the microphone provided with the arm according to the present invention.
Figure 4B:
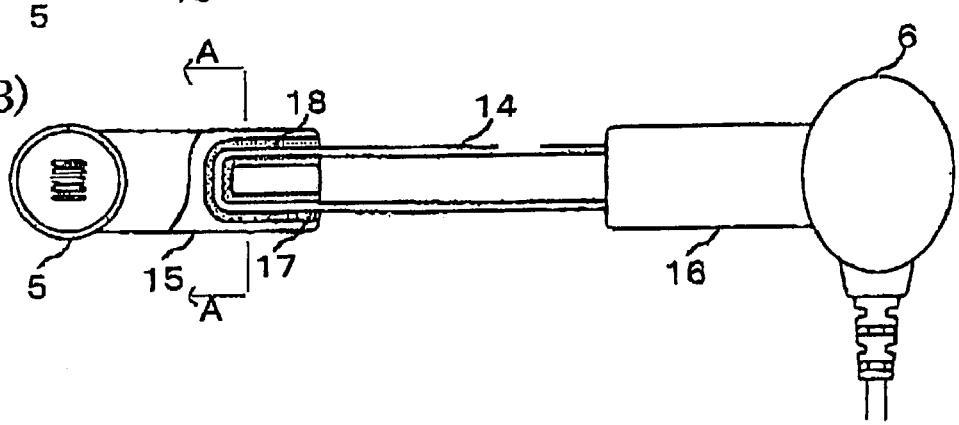
FIG. 4(*c*) is a plan view of the third embodiment with a curved arm.
Figure 4C:
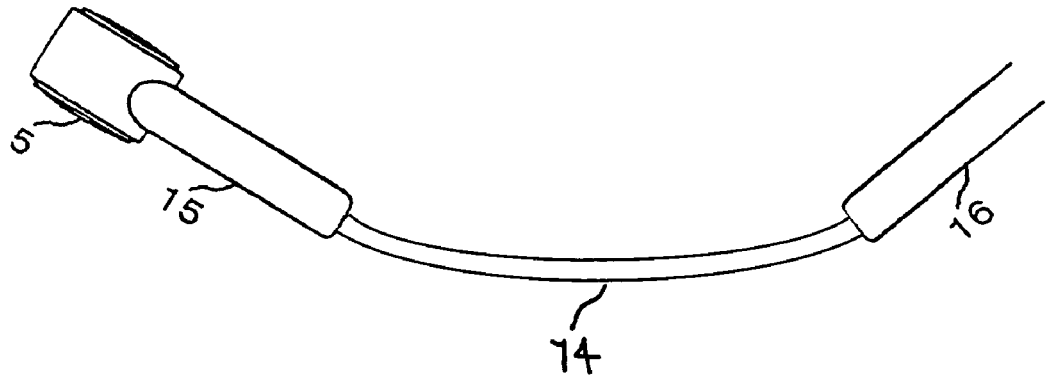

With reference to the accompanying drawings, embodiments of the present invention will be described. FIGS. 1, 3 and 4 show the individual embodiments of a microphone provided with an arm according to the present invention.

Figure 2:
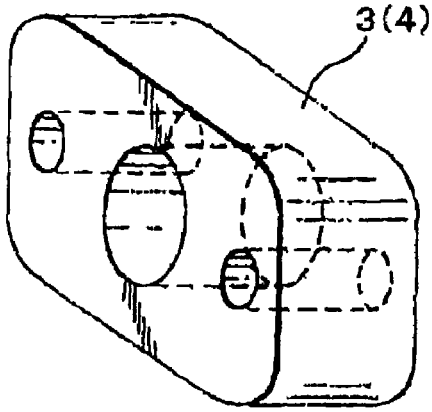
FIG. 2 is a perspective view illustrating an example of an elastic element in shape.

First, the microphone provided with the arm shown in FIGS. 1 and 2 will be described. In this embodiment, the arm is split into two pieces such as an arm 1 and an arm 2. The arm 1 is connected with the arm 2 through a pair of elastic elements 3, 4.

The arm 1 is constructed of a pair of rod members and has one of its opposite end portions fixedly connected with a microphone 5. The elastic elements 4 and 3 are disposed in the other end portion of the opposite end portions and an intermediate portion of the arm 1, respectively, in a manner such that the elastic elements 3, 4 bridge over the pair of the rod members. On the other hand, the arm 2 has one of its opposite end portions fixedly mounted on a loudspeaker 6 and the other end portion inserted into a central portion of each of the elastic elements 4, 3 and fixedly mounted therein, and further has the other end portion received in a space defined between the pair of the rod members of the arm 1 in a region between the elastic elements 3 and 4.

If necessary, at least one of the arms 1, 2 is curved in a manner such that the microphone 5 is directed toward a user's mouth. Further, it is also possible to provide a hinge mechanism in an intermediate portion of each of the arms 1, 2 so that the arms 1, 2 are angularly adjustable in position.

As described above, since the arm 1 is not directly connected with the arm 2 but indirectly connected with the arm 2 through the elastic elements 3 and 4, there is no fear that any vibration of the loudspeaker 6 is directly transmitted to the arm 1 (and the microphone 5) through the arm 2. The elastic elements 3, 4 are made of rubbers or plastics such as silicone resins and the like.

Next, the microphone provided with the arm shown in FIG. 3 will be described. In this embodiment, the arm is split into three pieces comprising an arm 7, an arm 8 and an arm 9. The arm 7 has the same construction as that of the arm 1, is provided with a pair of elastic elements 10, 11 and has one of its opposite end portions fixedly mounted on the microphone 5. Further, the arm 9 also has the same construction as that of the arm 1, is provided with a pair of elastic elements 12, 13 and has one of its opposite end portions fixedly mounted on the loudspeaker 6.

The arm 7 and the arm 9 are spaced apart from each other by an appropriate distance, and connected with each other through the arm 8. The arm 8 is inserted into central portion of each of the elastic elements 10~13 and fixedly mounted therein. The arm 8 shown in the above is received in a space between the rod members of each of the arms 7, 9 in the same manner as that of the arm 1 and the arm 2. As for the arms 7~9 in this case, it is possible to have them curved in the same manner as that described above, or to provide a hinge mechanism in each of the arms 7~9.

Figure 5:
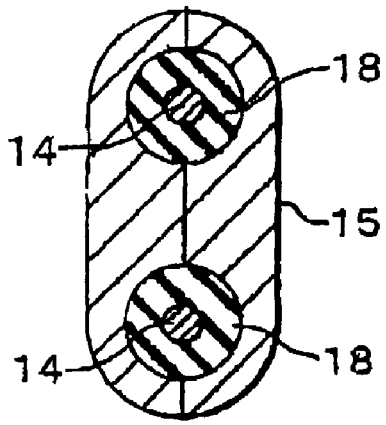
FIG. 5 is an enlarged sectional View taken along the line A—A of FIG. 4.

Subsequent to the above, the microphone provided with the arm shown in FIGS. 4 and 5 will be described. An arm 14 in this embodiment is an arm assuming a laterally elongated square shape, and has its opposite end portions fixedly embedded into arm mounting portions 15 and 16 which form extension portions of the microphone 5 and the loudspeaker 6, respectively.

An arm embedded groove 17 of each of the arm mounting portions 15, 16 assumes a ⊃-shaped form or a U-shaped form. One or both of the arm embedded grooves 17 is filled with an elastic element 18 in which an end portion of the arm 14 is inserted. It is needless to say that such an inserting operation of the arm 14 into the elastic member 18 is conducted in a condition in which each of the arm mounting portions 15, 16 is split into two pieces. The elastic element 18 may be previously fixedly mounted in an end portion of the arm 14. As for the arm 14 in this case, it is also possible to have the arm 14 curved and/or provided with a hinge mechanism therein in the same manner as that described above.

Figure 6:
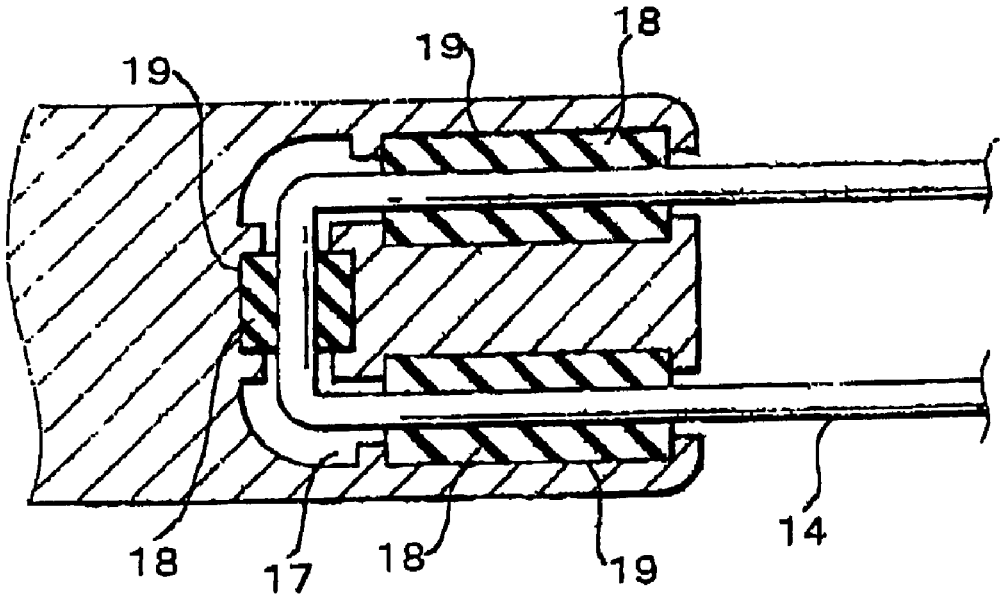
FIG. 6 is a view illustrating a modification of the embodiment shown in FIG. 4.

FIG. 6 shows another example of the arm embedded groove 17 in construction, wherein the elastic element 18 is split into three pieces each of which is adapted to be received in a concave portion 19 provided in the arm embedded groove 17. In this construction, it is possible to protect the elastic element 18 when the arm 14 is subjected to an excessive load or tension and a bending force.

Figure 7:
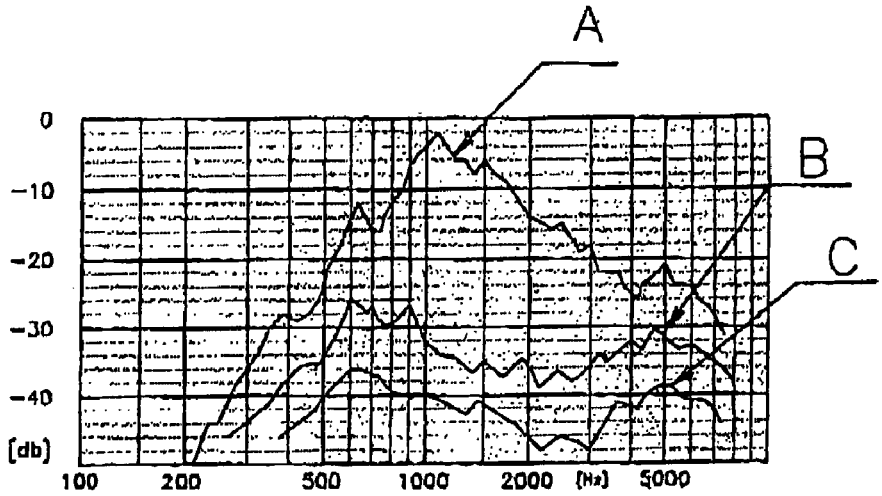
FIG. 7 is a view illustrating the relationship between an input of loudspeaker and an output of the microphone corresponding to the input.
Figure 8:
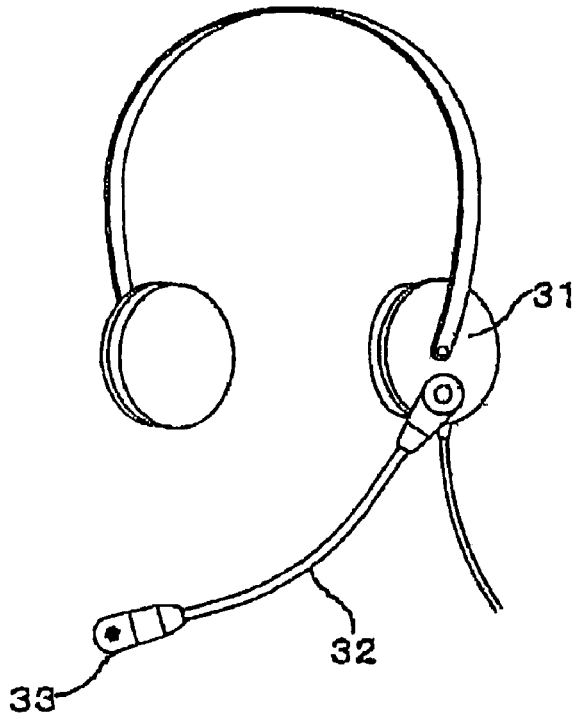
FIG. 8 (PRIOR ART)
FIG. 8 is a view illustrating an example of a set of a prior art loudspeaker and microphone.
Figure 9:
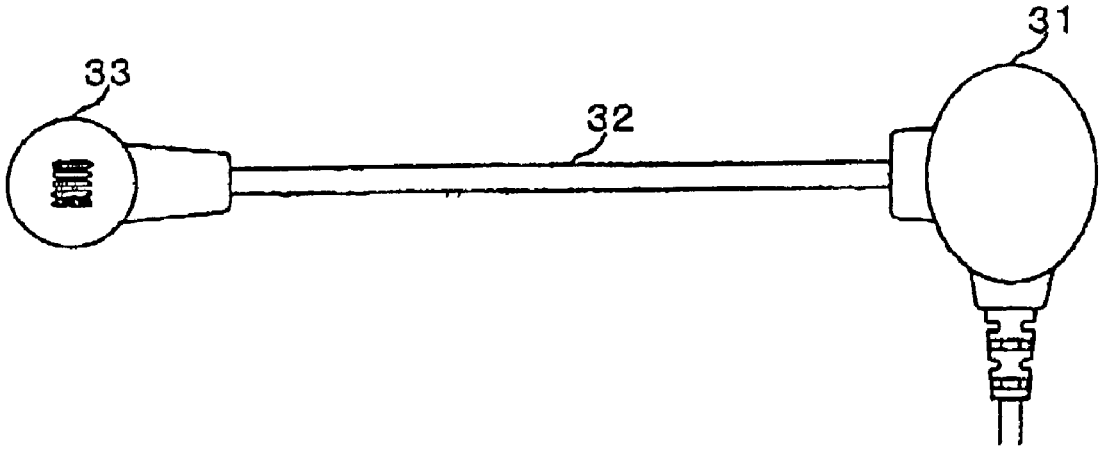
FIG. 9 (PRIOR ART)
FIG. 9 is a view illustrating another example of a set of a prior art loudspeaker and microphone.

FIG. 7 shows the results of measurement of an output issued from the microphone when a predetermined input is applied to the loudspeaker in a condition in which the microphone serves as a bone conduction loudspeaker. A curve "A" shows the measurement results of a conventional elastic element. A curve "B" shows the measurement results of the elastic element of the present invention when the number of the elastic elements of the present invention used in the measurement is two (FIG. 1). A curve "C" shows the measurement results of the elastic element of the present invention when the number of the elastic elements of the present invention used in the measurement is four (FIG. 3).

Judging from these experimental measurement results, it is recognized that: though a large effect is obtained when the number of the elastic elements of the present invention used is two, a much larger effect is obtained when the number of the elastic elements of the present invention used is four (a drop of approximately 30 (dB) is recognized in a range of 1~2.5 (kHz)).

All the above embodiments are of a type of a set having the arms mounted on the loudspeaker portion. In contrast with this, in a set of a desk type, each of the arms having the same construction of that of the arm used in the above embodiments is fixedly mounted on a desk stand.

INDUSTRIAL APPLICABILITY

Since the present invention has the above construction, it is possible for the present invention to remarkably reduce the influence of vibrations of the loudspeaker on the microphone. Further, by selecting the elastic element in material, it is possible for the present invention to obtain a further larger vibration isolating effect. Due to this, the present invention is remarkably useful in various types of communication instruments such as wireless communication instruments, cell phones and the like.

The invention claimed is:

1. A single microphone engaged within a housing and a supporting arm engaged within the housing to support the microphone, the supporting arm comprising a plurality of bars each having a first end, wherein each said first end is fixed within an elastic element which is fixed within said housing, and wherein said supporting arm has two lengths of bars which are parallel to each other and joined together at said first ends within said elastic element.

2. The single microphone according to claim 1, wherein said housing has a mounting portion which projects away from a portion of the housing in which the microphone is engaged, and said elastic member is fixed within said mounting portion.

3. The single microphone according to claim 2, wherein said mounting portion is made in two parts which form a groove within which said elastic member is fixed.

4. The single microphone according to claim 1, wherein said joined together first ends are U-shaped.

5. The single microphone according to claim 4, wherein said elastic member is made as a unit which surrounds the joined together first ends.

6. The single microphone according to claim 4, wherein said elastic element is made in three separated parts which surround the joined together first ends.

7. The single microphone according to claim 1, wherein the supporting arm has a laterally elongated rectangular shape including joined together second ends which are U-shaped.

8. The single microphone according to claim 7, wherein the supporting arm is curved.

9. The single microphone according to claim 7, wherein said joined together second ends are fixed within an elastic element which is fixed within a housing of a loudspeaker.

10. The single microphone according to claim 9, wherein the loudspeaker has a mounting portion which projects away from a portion of a housing in which the loudspeaker is engaged, said elastic member being fixed within said mounting portion of the loudspeaker.

11. The single microphone according to claim 7, wherein said joined together second ends are fixed within an elastic element which is fixed within a desk stand.

12. The single microphone according to claim 1, wherein second ends of the plurality of bars are slidably engaged through at least a second elastic element to a second supporting bar of a loudspeaker.

13. The single microphone according to claim 1, wherein second ends of the plurality of bars are slidably engaged through at least a second elastic element to a supporting bar on a desk stand.

* * * * *